US006034667A

United States Patent [19]

Barrett

[11] Patent Number: 6,034,667

[45] Date of Patent: Mar. 7, 2000

[54] METHOD AND APPARATUS FOR DISPLAYING YUV COLOR INFORMATION ON A PSEUDO-COLOR RGB DISPLAY

[75] Inventor: Peter T. Barrett, Palo Alto, Calif.

[73] Assignee: Radius Inc., Mountain View, Calif.

[21] Appl. No.: 08/139,456

[22] Filed: Oct. 20, 1993

Related U.S. Application Data

[63] Continuation of application No. 07/823,249, Jan. 21, 1992, abandoned.

[51] Int. Cl.[7] ..... G09G 5/04

[52] U.S. Cl. ..... 345/154; 345/155; 345/199; 382/167; 348/32

[58] Field of Search ..... 395/131; 345/431, 345/150, 153–154, 155, 199; 348/32, 33, 34; 382/167

[56] References Cited

U.S. PATENT DOCUMENTS

| | | | |
|---|---|---|---|
| 4,652,832 | 3/1987 | Jasper | 364/721 |
| 4,897,806 | 1/1990 | Cook et al. | 364/522 |
| 4,901,265 | 2/1990 | Kerr et al. | 364/721 |
| 4,905,241 | 2/1990 | Schmid et al. | 371/22.5 |
| 4,970,636 | 11/1990 | Snodgrass et al. | 364/518 |
| 4,984,247 | 1/1991 | Kaufmann et al. | 375/1 |
| 4,991,122 | 2/1991 | Sanders | 395/131 |
| 5,119,186 | 6/1992 | Deacon et al. | 358/78 |
| 5,144,308 | 9/1992 | Norsworthy | 341/131 |
| 5,175,807 | 12/1992 | Cawley et al. | 395/128 |
| 5,224,103 | 6/1993 | Ligthart et al. | 371/22.4 |

OTHER PUBLICATIONS

Three sheets of schematic circuit diagrams describing the Digital F/X TO200 product (dated Jun. 17, 1988).

*IEEE Standard Dictionary of Electrical and Electronics Terms, 3d ed., The Institute of Electrical and Electronics Engineers, Inc., 1984, pp. 696 and 727.

*Primary Examiner*—Ba Huynh

*Attorney, Agent, or Firm*—Limbach & Limbach L.L.P.

[57] ABSTRACT

A method and apparatus for displaying a color image stored in a YUV color format on a display device that generates video in an RGB format. The apparatus uses a frame buffer which stores a color index for each pixel. The index is used to select an RGB color in a color look-up table as the video signal is generated. Each input YUV value is converted to a mapping table index for addressing a pair of the color indices stored in a color space mapping table. To generate the mapping table index, a random number can be added to the Y, U, and V color components, which are then truncated and merged to generate the mapping table index. The color space mapping table is pre-loaded with a color index pairs, each corresponding to two pixels in the frame buffer represented by one input YUV color value. The appropriate color indices are based on the minimum error distance in a three dimensional YUV space, although the error in Y is weighted considerably stronger than U and V, since the human eye is more sensitive to errors in luminance than chrominance.

25 Claims, 4 Drawing Sheets

METHOD AND APPARATUS FOR DISPLAYING YUV COLOR INFORMATION ON A PSEUDO-COLOR RGB DISPLAY

CROSS-REFERENCE TO RELATED APPLICATION

The present application is a continuation of U.S. patent application Ser. No. 07/823,249, filed Jan. 21, 1992 now abandoned.

FIELD OF THE INVENTION

The present invention relates to a system and method for displaying full color images on a raster display screen which uses dithering and mapping techniques to provide a reasonable quality representation of the original full color image on a low-cost display system with a limited number of colors.

BACKGROUND OF THE INVENTION

Computer based raster display systems generally utilize a frame buffer to store information describing the displayed image. The frame buffer contains information for each pixel location on the display screen. In order to reduce cost, the amount of information for each pixel is limited to, for example, eight bits. These bits are then generally used to specify one of a range of colors contained in a color palette. These colors are generally specified in an RGB (red, green, and blue) color format.

This display system architecture is very common in low cost personal computers. This works well when the user is selecting the color for each object, such as when generating a diagram. However, this type of system has not generally been well suited to the display of natural images from, for example, a color television camera.

Images from a color television camera, TV tuner, or video tape recorder are generally represented in a composite video format. This format describes each pixel color using a luminance value (typically called Y) and two chrominance values (typically called U and V). To display this image on a computer display screen of the design discussed above, the luminance and chrominance information must be converted to index values which select from one of the possible colors provided by the color palette.

There are numerous problems that must be solved when converting from YUV color space to RGB color space including the complexity of the color space transformation, the selection of the optimum color from the palette, and the banding that results from the limited range of colors available.

Algorithms for converting from YUV color space to RGB color space are well known in the art, but are computationally expensive, typically requiring a number of multiplication operations for each pixel. This presents a serious problem for video processing since high performance is required to achieve smooth motion. The computational overhead necessary for performing these calculations can prevent a system that must perform such a conversion from operating in real-time.

The number of colors available in the color palette will typically be considerably less than the number of colors that can be represented by the YUV color values. For example, a typical personal computer has a color palette with 256 colors. The YUV color data, on the other hand, may specify one of millions of colors. To display the YUV image on a personal computer, the number of colors must be dramatically reduced.

One of the steps to reducing the number of colors is to quantize the color components so that they are described with fewer bits. A side effect of this quantization is a visual artifact known in the art as banding. This is best understood by considering a gradual transition from one color to another. If this transition is made with enough steps, this transition will appear smooth, with no obvious discontinuities. However, as the information storing color information is reduced to a representation having fewer bits known as quantizing, the number of available intermediate colors is reduced, thus, decreasing the number of steps that can be utilized. The difference from one step to the next becomes exaggerated. The steps begin to appear as bands on the display and are particularly distracting in natural images.

A well known technique to reduce the effects of quantization is to add noise to the signal before quantizing. This technique is also known as dithering. This tends to make the transition from one step to the next less uniform and therefore less apparent to a viewer.

This approach to dithering has not typically been applied to image quantization. In certain experimental systems, noise has been added to the RGB components before quantization. However, when enough noise is added to reduce the banding effect, the resulting color values often have significantly different spectral content and the resulting image has unacceptable color speckling.

Once the pixel value has been converted to RGB space, algorithms are known for selecting the closest color from a color palette. However, these algorithms do not take advantage of our knowledge of the human vision system. Early color television research indicated a much higher sensitivity to intensity accuracy than to color accuracy. Nevertheless, conventional algorithms use only a simple error calculation in RGB space to determine the selected color rather than intensity.

Thus, several objects of this invention are to provide a fast, efficient method to convert color values specified in a luminance/chrominance format to values that can be stored in the frame buffer which will select an optimal color from the color palette, and to provide techniques to reduce the banding artifacts that often result from the use of a limited range of colors.

SUMMARY OF THE INVENTION

The method and system of the present invention converts a pixel color specified in a YUV color space to a mapping look-up table index value. A random noise signal (preferably a pseudo-random noise signal) is added to the Y, U, and V components to reduce the banding that results from the small number of available colors. Adding noise to RGB signals has been used to reduce the effects of quantization. However, this technique can result in unpleasant color speckling.

Once the noise is added, the Y, U, and V components are quantized to fewer bits. In the preferred embodiment, Y, U, and V are quantized to 6, 4, and 4 bits respectively, resulting in a total of 14 bits required to represent the color.

The concatenation of these bits is used as an index into a pre-computed color space mapping table which contains the values to be loaded into the frame buffer. In the preferred embodiment, the color space mapping table has 16,384 entries, and each entry has two bytes. The two bytes (a "color value pair" consisting of two color palette indices) define the values for two horizontally contiguous pixels stored in the frame buffer.

Several significant functions are accomplished by the color space mapping look-up table. The table contains what are believed to be the optimal two color palette indices to display the color represented by each input YUV value. One of the significant elements of this invention is the calculation of the entries to be stored in this table.

Since this invention will often be used in a video environment, it is typically not possible to change the color palette for each new image. There are various techniques known in the art for generating a color palette which provides a range of colors to choose from.

Once an RGB palette is known for a given system, the first step in the process of creating the color space mapping table is to create a separate table which contains a YUV color space representation of each of the color palette entries. This is done by transforming each of the RGB colors in the color palette to the YUV color space using known techniques.

Each index into the color space mapping table is a quantized YUV color. The next step in the process of creating the color space mapping table is to produce, for each index into the color space mapping table, an expanded YUV value. The YUV entry (in the table of YUV values representing the color palette) that is closest to an expanded YUV value is found by summing the absolute value of the difference between the three color components of the expanded YUV value and the three color components of each YUV entry (from the table of YUV values representing the color palette). However, unlike conventional techniques, the difference between Y components is weighted much higher to take advantage of the human eye's increased sensitivity to intensity variations.

In the preferred embodiment, the color palette index corresponding to the YUV entry (from the table of YUV values representing the color palette) which produces the minimum weighted error is selected as the first color palette index of a color value pair to be stored in the color space mapping table in a location indexed by the corresponding expanded YUV value (the expanded YUV value corresponds to a "mapping look-up table index"). The second color palette index of the color value pair indexed by the expanded YUV value determines the next horizontally contiguous pixel to be displayed, and is calculated using the same method except that the error from the first calculation is propagated to the second. For example, if the best match (the YUV value selected as a result of the first calculation) was slightly too high in intensity, the second calculation will attempt to find a YUV entry (from the table of YUV values representing the color palette) that is slightly too low in intensity. The color palette index corresponding to this latter YUV entry is then stored in the color space mapping table, as the second color palette index of the color value pair.

This method of using error propagation to identify color palette indices, though implemented in RGB space, has never been used in YUV space. Further, it has not previously been combined with the other features of this invention.

These and other objects and features of the present invention will be understood more fully from the following detailed description which should be read in light of the accompanying drawings in which corresponding reference numerals are discussed in the text, and refer to corresponding parts throughout several views.

DESCRIPTION OF THE PREFERRED EMBODIMENTS

Figure 1:
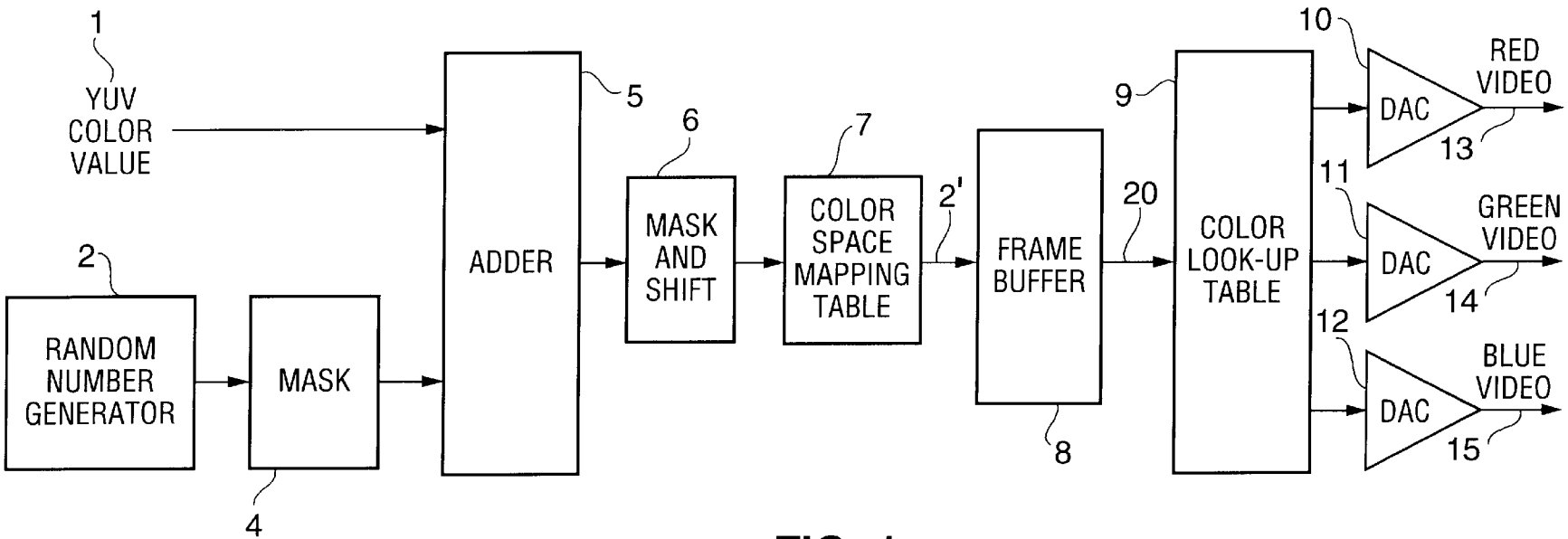
FIG. 1 is a block diagram of the system to display YUV color image on a pseudo-color raster display; screen according to the present invention.

The preferred embodiment of the present invention is a combination of a software and hardware implementation shown in the block diagram of FIG. 1. Referring to FIG. 1, the frame buffer, 8, color look-up table, 9, and digital to analog converters, 10, 11, 12, are elements of a computer system such as a personal computer system like an APPLE MACINTOSH. (APPLE and MACINTOSH are Trademarks of Apple Computer Corporation.)

The operations indicated by the other functional blocks in FIG. 1 are implemented as a system on a general purpose microprocessor such as the Motorola 68030 and includes a sequential software program. This processor is typical of the microprocessors used in personal computer systems such as the Apple Macintosh. A similar program could also be implemented on personal computers and work stations utilizing other microprocessors such as the 80486, SPARC, etc. (80486 is a Trademark of Intel Corporation. SPARC is a Trademark of Sun Corporation.) This invention could be applied to consumer products incorporating commodity microprocessors or digital signal processors.

The frame buffer 8, is a memory buffer having a memory location containing the information used to display each pixel on a raster scan display screen (not shown). The frame buffer 8 is continuously read in accordance with well known video timing techniques to generate a sequence of data values 20, each of which specifies a color index for one of the pixels of the display. Each color index is used to select a color from the color look-up table 9 (also called the color palette). This selected color has three components, each of which provides the control information to an appropriate one of the three digital to analog converters 10, 11, 12. In a typical personal computer system such as the Apple Macintosh, these digital to analog converters are used to generate the red, green, and blue video control signals, 13, 14, 15, which control the operation of a color raster scan display monitor, causing the image specified by the contents of the frame buffer 8 to be displayed.

The color index values to be loaded into the frame buffer is determined based on an image defined by YUV format color values 1. The appropriate index values depend on the contents of the color look-up table 9. The invention will work with any selection of colors, although some color palettes will result in higher quality images than others. An algorithm to generate an appropriate palette for this application is shown by the pseudo-code below.

```
/* This code is intended to show how a color look-up table */
/* might be generated. Although the code resembles "C" code, */
/* it is not intended to be a working program. */
int generate_palette ( )
{
int i, j, k, y_comp, u_comp, v_comp;
int index, rgb_palette[256];
```

-continued

```
/* Initialize variables. */
index = 0;
y_comp = 16;
u_comp = 48;
v_comp = 48;
/* Three nested loops to cycle through Y, U, and V. */
for ( i=0, i<16, i++ ) {
      for ( j=0, j<4, j++ ) {
         for (k=0, k<4, k++ ) {
/* The following function call converts the Y, U, and V */
/* components to a 24 bit RGB value which is loaded into the */
/* color look-up table. Since these transformation techniques */
/* are well known, this function is not included for brevity. */
         rgb_palette[index] = rgb_convert(y_comp, u_comp, v_comp);
         index++;
         v_comp = v_comp + 59;
         }
      v_comp = 48;
      u_comp = u_comp+59;
      }
   u_comp = 48;
   y_comp = y_comp+15;
   }
}
```

For each YUV color value 1 in the image, two color palette index values 2' are generated and asserted to frame buffer 8. Most of the objects of the invention are handled by a simple table look-up operation. This table look-up converts a modified version of the YUV data directly to the index values 2'. The contents of the table (color space mapping table 7 of FIG. 1) for accomplishing this look-up operation will be described below.

Figure 2:
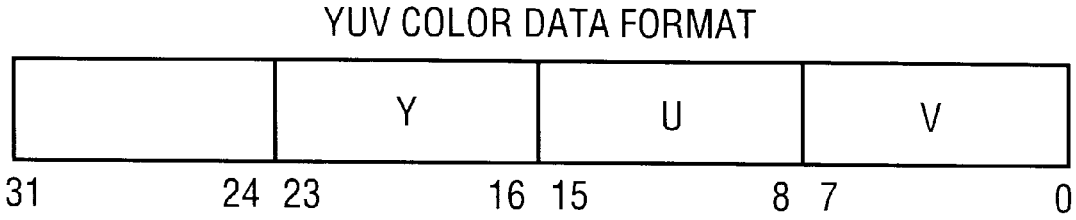
FIG. 2 shows the data format of the YUV pixel data.

Since the original YUV data 1 is a 24 bit value (typically contained in a 32 bit long word), as shown in FIG. 2, some mechanism must be provide to reduce the number of bits so that the size of table 7 is not prohibitive. Although this may not be necessary in the future as the cost of memory continues decrease, personal computer systems that are currently available cannot allocate enough memory to support a table this large.

The approach to reducing the size of the YUV data in the preferred embodiment is to quantize each component to a smaller number of bits. However, this results in banding as described in the background section. To reduce banding, random noise is added to each of the Y, U, and V components using the adder 5 shown in FIG. 1. Since this noise is added while the color data is still in YUV format, the color speckling that occurs when adding noise to RGB data can be significantly reduced since the noise is uncorrelated. Further, different amounts of the noise can be selectively added to any one of the YUV components. In the preferred embodiment, much more noise can be added to the luminance (Y) component than could have been equivalently added to RGB components resulting in a significant reduction to the banding while only adding a slight amount of color speckling.

The noise is preferably random and is generated using random number generator 2 which is implemented using the well known linear feedback counter. In the preferred embodiment, this is implemented in software by shifting a 32 bit long word right one bit. If the bit shifted from the LSB is '0', the value in the register is XORed with $A3000000 (a hexadecimal number). This results in a pseudo-random number which only repeats after 2321 iterations. Since this is many more iterations than there are pixels in the image, the noise signal appears totally random in the resulting image.

The pseudo-random number is then masked 4 so that only small noise components are added to each of the Y, U, and V color components. In the preferred embodiment, the mask operation is performed in software by ANDing the pseudo-random number with $00030F0F (a hexadecimal number). This results in a long word which has a noise component ranging from 0 to 15 in the byte positions corresponding to the chrominance components (U and V), and a noise component ranging from 0 to 3 (decimal) in the byte position corresponding to the luminance (Y) component.

The masked pseudo-random number is then added to the original YUV color value using the adder 5. In the preferred embodiment, this operation is implemented with a single long-word add. Note that the generation of the pseudo-random number 2 the masking operation 4 and the add operation 5 can all be implemented using long-word instructions without requiring independent operations on each of the Y, U, and V color components. This makes the algorithm very efficient to implement on commodity microprocessors such as those found in personal computers such as the Apple Macintosh.

In the preferred embodiment, overflow from one of the Y, U, and V color components during the add operation is not a problem because the range of the Y values is 16–235 (decimal) and the in and V values is 48–224 (decimal). Therefore, it is not possible even when adding the largest noise value to the largest incoming value to have an overflow. If this were not the case, some form of check would have to be performed for overflow to prevent the values from wrapping around.

Figure 3:
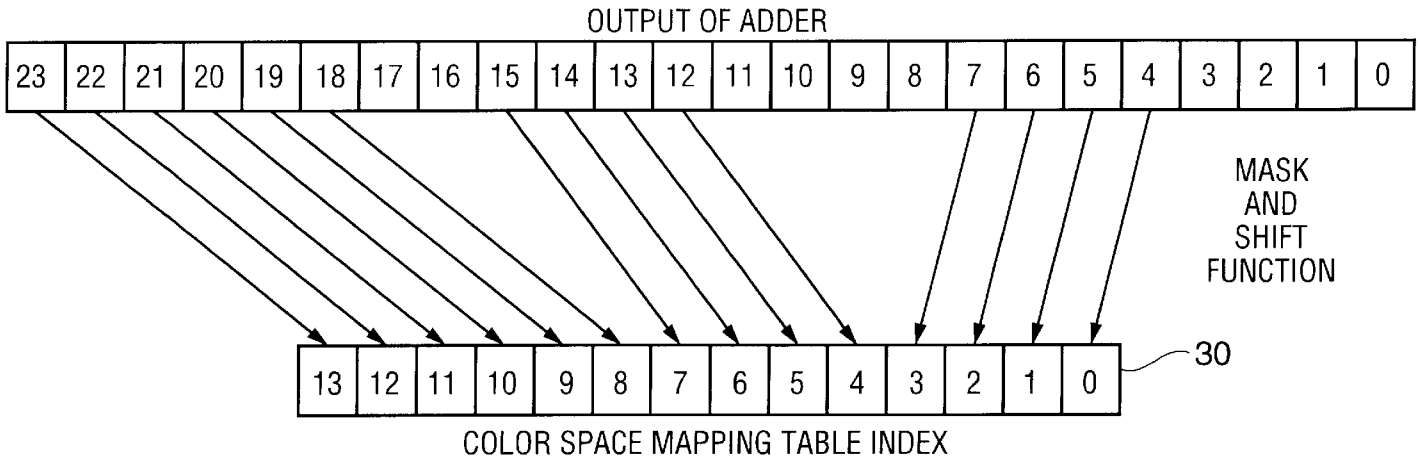
FIG. 3 shows the operation of the mask and shift function used to generate the index to the color space mapping table.

Once the noise has been added to the YUV color value, each of the components are quantized and concatenated by the mask and shift block 6. FIG. 3 shows the operation of the mask and shift function used to generate the index to color space mapping table 7. The most significant four bits of the V component are shifted into bits 0–3 of the color space mapping table index. The most significant four bits of the U component are shifted into bits 4–7 of the color space mapping table index. The most significant six bits of the Y component are shifted into bits 8–13. This results in a 14 bit color space mapping table index, allowing color space mapping table 7 to be implemented with 16,384 (decimal) entries.

In the preferred embodiment, the YUV image is represented at half the horizontal resolution and the same vertical resolution as the frame buffer resolution. This means that the conversion of one YUV pixel results in two index values written to the frame buffer. To convert an entire image, this process is repeated for all YUV pixels, which are typically provided in raster scan order, from left to right and from top to bottom.

Figure 4:
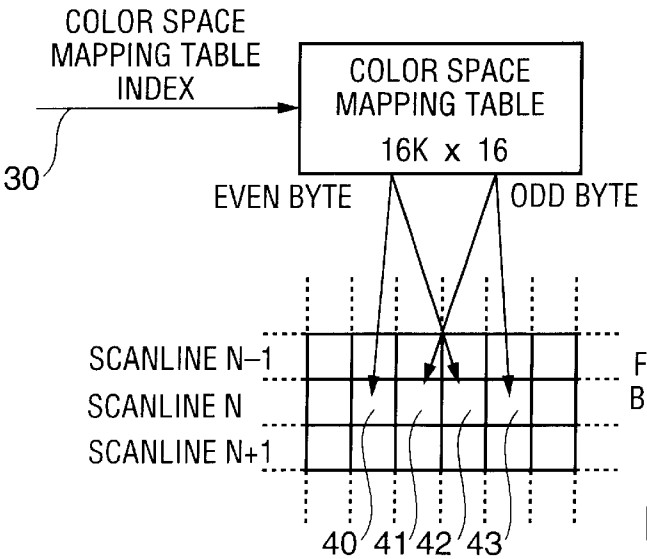
FIG. 4 shows a representation of mapping from the color space mapping table to the frame buffer.

For each color space mapping table index, two bytes (a "color value pair") are accessed from the embodiment of color space mapping table 7 shown in FIG. 4. As shown in this figure, the first access to color space mapping table 7 will read two bytes. The even byte will be written to a first frame buffer location 40. The odd byte will be written to the next adjacent location 41. The next color space mapping table index will read another two bytes (a second color value pair) which will be written to the next two adjacent locations 42 and 43 as shown.

Figure 5:
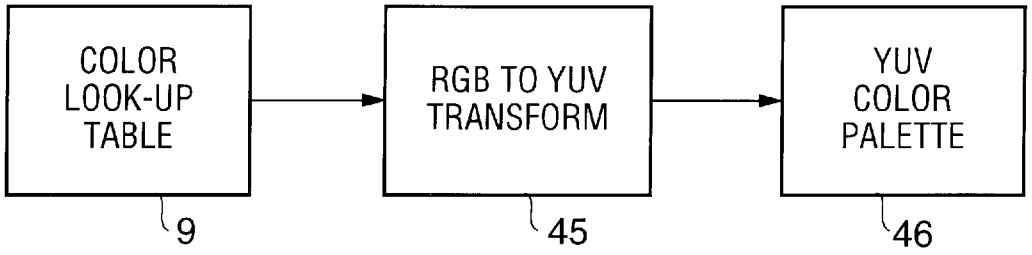
FIG. 5 represents certain operations performed to create the color space mapping table of the invention.

To calculate the data in color space mapping table 7, the optimal color palette index values for each YUV color value must be determined. Referring to FIG. 5, YUV space palette 46 (a duplicate, in YUV space, of RGB color palette 9) is generated by executing transform 45 so as to transform the RGB color entries of color palette 9 to the YUV color entries of palette 46.

The specific transformation 45 depends on the specific format of the YUV data, but a typical transformation can be accomplished with the following equation.

$$\begin{bmatrix} Y \\ U \\ V \end{bmatrix} = \begin{bmatrix} 0.299 & 0.587 & 0.114 \\ -0.147 & -0.289 & 0.436 \\ 0.615 & -0.515 & -0.199 \end{bmatrix} \begin{bmatrix} R \\ G \\ B \end{bmatrix}$$

Figure 6:
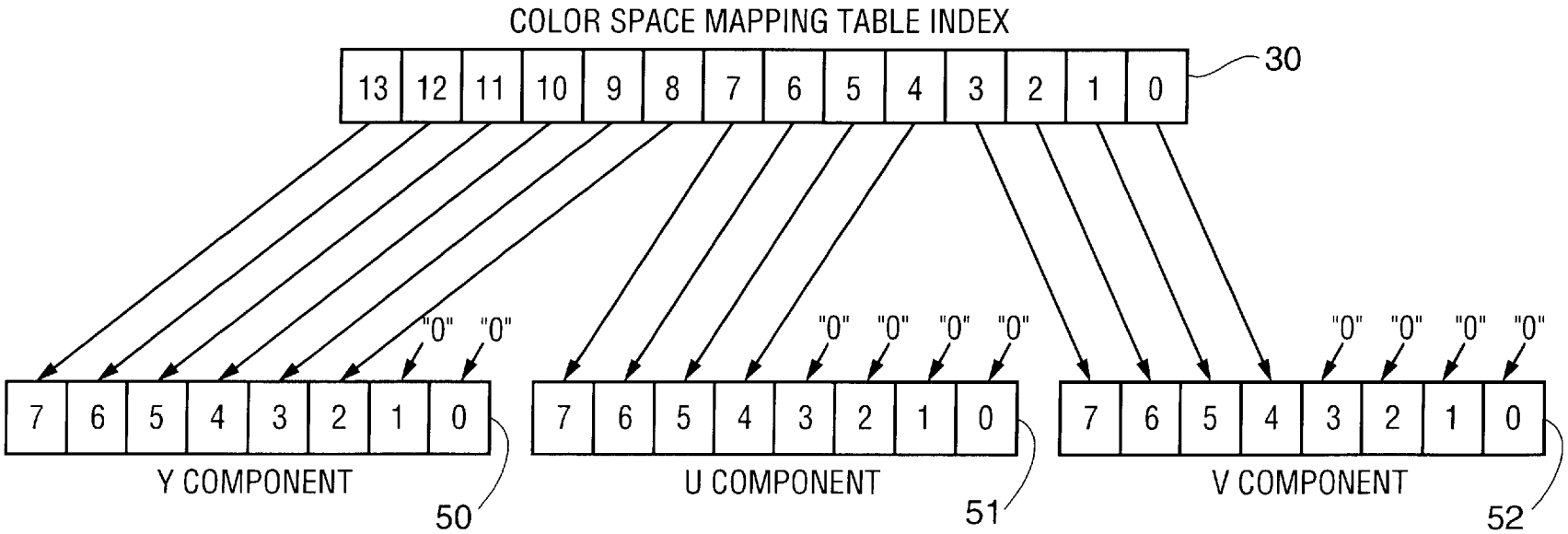
FIG. 6 shows the expansion of a color space mapping table index into an expanded YUV value (comprising three Y, U, and V components) used to calculate a corresponding color space mapping table entry.

For each possible color space mapping table index, an expanded Y, U, and V color triplet ("expanded YUV value") is generated by reversing the effect of the mask and shift function shown in FIG. 3. This expansion operation is shown in the block diagram of FIG. 6.

For each expanded YUV value (and hence for each color space mapping table index), an error value is computed for each entry of YUV palette 46. This is done by taking the absolute value of the difference between each of the Y, U, and V components of each of the entries of palette 46 and a corresponding one of the expanded Y, U, and V components 50, 51, and 52 of the expanded YUV value. Instead of simply summing each triplet of three difference values (one for each of the three color components) to generate a total error signal, the luminance error is first weighted by multiplying the absolute value of the difference in Y by a weighting factor which is four in the preferred embodiment. The total weighted error is therefore given by the following equation.

$$\text{Error}_{weighted} = 4|Y_{expanded} - Y_{palette}| + |U_{expanded} - U_{palette}| + |V\text{expanded} - V_{palette}|$$

The index value (of color palette 9) associated with the YUV palette color with the minimum total weighted error is the value loaded into the color space mapping table for the first byte (even byte) for the entry (i.e., the expanded YUV value, and corresponding mapping look-up table index) in question.

The second byte (the second color palette index loaded into the color space mapping table for the same expanded YUV value) is calculated using an error propagation technique. The actual error resulting from the first YUV palette color selection (the value of palette 46 which determined the first byte loaded in the color space mapping table) is added to the expanded YUV color 50, 51, 52, to determine what is called the error propagated color. By propagating the error from the first YUV palette color selection (corresponding to the first "color palette index" stored in the color space mapping table, which in turn corresponds to frame buffer location 40), to the second "color palette index" stored in the color space mapping table (which corresponds to frame buffer location 41), the error can be partially offset. For example, if the best choice entry of palette 46 selected for the first byte has a luminance that is higher than the expanded YUV color 50, 51 and 52 then the algorithm will attempt to find a palette color for the second frame buffer index 41 that is low by the same amount.

The first step in the calculation of the error propagated colors is to generate the values shown in the following equations, where the YUV palette color components ($Y_{palette}$, $U_{palette}$, and $V_{palette}$) are those which determined first byte 40 in the color space mapping table (said first byte being indexed by the color mapping look-up table index corresponding to the expanded YUV value $Y_{expanded}$, $U_{expanded}$, and $V_{expanded}$):

$$Y_{err\cdot prop} = 2Y_{expanded} - Y_{palette}$$

$$U_{err-prop} = 2U_{expanded} - U_{palette}$$

$$V_{err-prop} = 2V_{expanded} - V_{palette}$$

The second byte 41 of the color space mapping table entry can now be calculated in the same manner as the first, except that the propagated error color components are used instead of the expanded color components in the error minimization calculation. A weighted error is calculated as before and is defined by the equation shown below:

$$\text{Error}_{weighted} = 4|Y_{err-prop} - Y_{palette}| + |U_{err-prop} - U_{palette}| + |V_{err-prop} - V_{palette}|$$

As with the calculation of the first byte, the color palette index value associated with the YUV palette color with the minimum total weighted error is the value loaded into the color space mapping table for the second byte (odd byte) 41 for the entry in question.

The previous discussion assumed a linear mapping from YUV to RGB color spaces. It is also possible to effect non-linear mapping operations to perform functions such as contrast modification, hue and saturation adjustments, etc. This can accomplished by modifying transformation 45 used to generate the entries of the YUV palette 46. The specific modifications are known in the art and are not directly pertinent to the invention.

Although some of the operations required to implement these algorithms have been represented as independent functional blocks, it will be apparent to one of ordinary skill in the art that many of these operations can easily be accomplished in a sequential manner on a commodity microprocessor such as those found in low cost desk top personal computers. It will also be apparent that these operations could be implemented in specialized hardware and performed in a parallel or pipelined fashion if very high performance is required.

While the foregoing invention has been described with reference to its preferred embodiments, various modifications and alterations will occur to those skilled in the art. All such modifications and alterations are intended to fall within the scope of the appended claims.

What is claimed is:

1. An apparatus for converting input image data specified in a YUV format into display image data specified as color index values which are mapped through an RGB color palette for display on a raster scan video display, where the input image data are sequentially received input pixels, each of said input pixels including Y component bits, U component bits, and V component bits, said apparatus comprising:

means for adding noise to at least one of the Y component bits, the U component bits, and the V component bits of each of the input pixels, thereby generating a dithered input pixel comprising a first number of bits for said each of the input pixels;

a means for quantizing each said dithered input pixel to generate a mapping look-up table index comprising a second number of bits, where the second number is less than the first number; and a mapping look-up table means for receiving each said mapping look-up table index and outputting a color index pair in response to each said mapping look-up table index, wherein the mapping look-up table means includes storage locations, each of the storage locations stores a pair of color index values which map to horizontally contiguous pixels of the raster scan video display, and each said color index pair consists of one said pair of color index values.

2. The apparatus of claim 1, also including:

a frame buffer coupled to an output of the mapping look-up table means for storing a plurality of the color index pairs output sequentially from said mapping look-up table means.

3. The apparatus of claim 1, also including:

means for converting each said color index pair into a pair of horizontally contiguous RGB pixels of the display image data.

4. The apparatus of claim 3, wherein the means for converting each said color index pair into a pair of horizontally contiguous RGB pixels includes:

a color look-up table means coupled to an output of the frame buffer, for outputting an RGB pixel signal in response to each of the color palette indexes of each said color index pair; and a digital to analog converter coupled to an output of the color look-up table means for forming an analog red video signal, an analog green video signal, and an analog blue video signal in response to each said RGB pixel signal output from the color look-up table means.

5. The apparatus of claim 1, wherein the noise is pseudo-random noise.

6. The apparatus of claim 1, wherein the means for quantizing each said dithered input pixel consists of means for masking and shifting each said dithered input pixel.

7. The apparatus of claim 1, wherein a first color index value of each said color index pair is chosen to be a best match to an expanded YUV value corresponding to one said mapping look-up table index, and a second color index value of each said color index pair is chosen to be a best match to an error-propagated YUV color value that is a component by component sum of the expanded YUV value and the error to the best match between the first color index value and the expanded YUV value.

8. An apparatus for converting input image data specified in a YUV format into display image data specified in a RGB format for display on a raster scan video display, where the input image data are sequentially received input pixels, each of said input pixels including Y component bits, U component bits, and V component bits, said apparatus comprising:

means for adding noise to at least one of the Y component bits, the U component bits, and the V component bits of each of the input pixels, thereby generating a dithered input pixel comprising a first number of bits for said each of the input pixels;

a means for masking and shifting each said dithered input pixel to generate a mapping look-up table index comprising a second number of bits, where the second number is less than the first number;

a mapping look-up table means for receiving each said mapping look-up table index and outputting a color index pair in response to each said mapping look-up table index, wherein the mapping look-up table means includes storage locations, each of the storage locations stores one said color index pair, and each said color index pair is a pair of color palette indices; and means for converting each said color index pair into a pair of horizontally contiguous RGB pixels of the display image data.

9. The apparatus of claim 8, also including:

a frame buffer coupled to an output of the mapping look-up table means for storing a plurality of color index pairs output sequentially from said mapping look-up table means.

10. The apparatus of claim 9, wherein the means for converting each said color index pair into a pair of horizontally contiguous RGB pixels includes:

a color look-up table means coupled to an output of the frame buffer, for outputting an RGB pixel signal in response to each of the color palette indices of each of the color index pairs; and a digital to analog converter coupled to an output of the color look-up table means for forming an analog red video signal, an analog green video signal, and an analog blue video signal in response to each said RGB pixel signal output from the color look-up table means.

11. The apparatus of claim 8, wherein the noise is pseudo-random noise.

12. The apparatus of claim 8, wherein each said mapping look-up table index includes a quantized Y component consisting of 6 binary bits, a quantized U component consisting of 4 binary bits, and a quantized V component consisting of 4 binary bits.

13. The apparatus of claim 8, wherein the means for adding noise comprises a linear feedback counter.

14. The apparatus of claim 13, wherein the means for adding noise also includes means for shifting a sequence of 32 bit words out of a shift register and means for exclusive oring a 32 bit word in the shift register with a constant value each time a least significant bit of a 32 bit word shifted out of the shift register is '0'.

15. The apparatus of claim 14, wherein the constant value is $A3000000 (hexadecimal).

16. A method of converting image data specified in a YUV format into display image data specified in a RGB format for display on a raster scan video display, comprising the steps of:

(a) receiving image data for drawing a pixel, where the image data are in a YUV format and include Y component data, U component data, and V component data;

(b) adding noise to at least one of the Y component data, the U component data, and the V component data, thereby forming a dithered YUV pixel signal comprising a first number of bits for one of said input pixels;

(c) generating from the dithered YUV pixel signal, a mapping look-up table index comprising a second number of bits, where the second number is less than the first number;

(d) supplying the mapping look-up table index to a mapping look-up table, and selecting a first color palette index and a second color palette index stored in the mapping look-up table in response to the mapping look-up table index; and (e) displaying a pair of RGB pixels of the display image data, in response to the first color palette index and the second color palette index that have been selected in response to said mapping look-up table index.

17. The method of claim 16, wherein the RGB pixels of each said pair of RGB pixels are horizontally contiguous.

18. The method of claim 16, also including the step of generating the mapping look-up table before performing step (d), wherein the step of generating the mapping look-up table includes the steps of:

determining a luminance value Y" and chrominance values U" and V" for each RGB value of an RGB color palette for the display image data;

generating an expanded YUV value, comprising bits Y', U', and V', for each said mapping look-up table index; and selecting as the first color palette index for each said mapping look-up table index, an index to the RGB value which corresponds to values $Y_m''$, $U_m''$, and $V_m''$, wherein the values $Y_m''$, $U_m''$, and $V_m''$ are determined by minimizing an error value E over all values Y", U", and V", to determine a minimum error $E_m$, where E is substantially equal to LA+MB+NC, where L, M, and N are weighting factors, A is the absolute value of Y"−Y', B is the absolute value of U"−U', C is the absolute value of V"−V', $E_m=LA_m+MB_m+NC_m$, where $A_m$, is the absolute value of $Y_m''-Y'$, $B_m$ is the absolute value of $U_m''-U'$, and $C_m$ is the absolute value of $V_m''-V'$.

19. The method of claim 18, wherein the step of generating the mapping look-up table also includes the steps of:

selecting as the second color palette index for each said mapping look-up table index, an index to the RGB value which corresponds to values $Y_e''$, $U_e''$, and $V_e''$, wherein the values $Y_e''$, $U_e''$, and $V_e''$ are determined by generating an error propagated expanded index comprising bits Y'", U'", and V'" from the expanded YUV value for the mapping look-up table index, and then minimizing an error value E' over all values Y", U", and V", where E' is substantially equal to LA'+MB'+NC', where A' is the absolute value of Y"−Y'", B' is the absolute value of U"−U'", and C' is the absolute value of V"−V'".

20. The method of claim 18, wherein M is substantially equal to N, and L is substantially equal to 4N.

21. The method of claim 16, wherein step (b) includes the steps of:

adding a signal indicative of a pseudo-random number to each of the Y component data, the U component data, and the V component data, thereby forming Y, U, and V noise components;

quantizing the Y, U, and V noise components, thereby forming quantized Y, U, and V components; and concatenating the quantized Y, U and V components thereby forming the dithered YUV pixel signal.

22. A method for generating a mapping look-up table for use in converting image data specified in a YUV format into display image data specified in a RGB format for display on a raster scan video display, said method including the steps of:

determining a luminance value Y" and chrominance values U" and V" for each RGB value of an RGB color palette for the display image data;

generating an expanded YUV value, comprising bits Y', U', and V', for each mapping look-up table index of a set of mapping look-up table indices; and selecting as a first color palette index for said each mapping look-up table index, an index to the RGB value which corresponds to values $Y_m''$, $U_m''$, and $V_m''$, wherein the values $Y_m''$, $U_m''$, and $V_m''$ are determined by minimizing an error value E over all values Y", U", and V", to determine a minimum error $E_m$, where E is substantially equal to LA+MB+NC, where L, M, and N are weighting factors, A is the absolute value of Y"−Y', B is the absolute value of U"−U', C is the absolute value of V"−V', $E_m=LA_m+MB_m+NC_m$, where $A_m$ is the absolute value of $Y_m''-Y'$, $B_m$ is the absolute value of $U_m''-U'$, and $C_m$ is the absolute value of $V_m''-V'$.

23. The method of claim 22, also including the steps of:

selecting as a second color palette index for said each mapping look-up table index, an index to the RGB value which corresponds to values $Y_e''$, $U_e''$, and $V_e''$, wherein the values $Y_e''$, $U_e''$, and $V_e''$ are determined by generating an error propagated expanded index comprising bits Y'", U'", and V'" from the expanded YUV value for the mapping look-up table index, and then minimizing an error value E' over all values Y", U", and V", where E' is substantially equal to LA'+MB'+NC', where A' is the absolute value of Y"−Y'", B' is the absolute value of U"−U'", and C' is the absolute value of V"−V'".

24. The method of claim 23, also including step of:

storing the first color palette indices and the second color palette indices in storage locations of the mapping look-up table, so that both the first color palette index and the second color palette index for each mapping look-up table index are stored in a common storage location of the mapping look-up table.

25. The method of claim 22, wherein M is substantially equal to N, and L is substantially equal to 4N.

* * * * *